United States Patent [19]

Vergnetti

[11] Patent Number: 4,664,367

[45] Date of Patent: May 12, 1987

[54] WORKPIECE STACKER FOR SEWING MACHINES

[76] Inventor: Joseph A. Vergnetti, R.D. #3, Box 465, Lake Ariel, Pa. 18436

[21] Appl. No.: 697,628

[22] Filed: Feb. 4, 1985

[51] Int. Cl.[4] ..... B65H 29/46

[52] U.S. Cl. ..... 271/175; 112/121.29

[58] Field of Search ..... 271/175, 184, 185, 225, 271/84, 85; 112/121.29

[56] References Cited

U.S. PATENT DOCUMENTS

| | | | |
|---|---|---|---|
| 3,701,328 | 10/1972 | Frost | 112/121.29 |
| 4,067,272 | 1/1978 | Marforio | 271/175 X |
| 4,144,825 | 3/1979 | Angele et al. | 112/121.29 |

FOREIGN PATENT DOCUMENTS

| | | | |
|---|---|---|---|
| 1253171 | 11/1971 | United Kingdom | 271/175 |

*Primary Examiner*—Duane A. Reger
*Assistant Examiner*—Matthew C. Graham
*Attorney, Agent, or Firm*—David A. Tamburro

[57] ABSTRACT

A workpiece stacker located at the side of a table on which a sewing machine is mounted. The stacker includes mechanism whereby a workpiece is transferred from the back of the table behind the sewing machine and stacked on a support arm adjacent the front of the table where the stacked workpieces are readily accessible to the operator seated at the front of the machine.

7 Claims, 6 Drawing Figures

WORKPIECE STACKER FOR SEWING MACHINES

BACKGROUND OF THE INVENTION

This invention relates generally to workpiece stacking mechanism used with sewing machies, and more particularly to a novel workpiece stacker which is constructed and positioned in such a way as to conserve valuable space around the sewing machine table and to better utilize operator time and energy.

Work stacking devices for sewing machines have been proposed in the past. The most common devices have been located behind the worktable away from the operator, and typical of these are shown in U.S. Pat. No. 3,618,546, 3,383,107, and 3,345,963. Devices such as these occupy valuable space behind the sewing machine and also require the operator to leave her seated position in front of the machine to remove the completed stack of garments from the device. A side mounted work stacking mechanism for sewing machines is proposed in U.S. Pat. No. 3,123,031. However it is very complex in construction, and the operator agains must leave her seated position to remove the stacked bundle of garments.

SUMMARY OF THE INVENTION

Accordingly, the primary object of this invention resides in the provision of a side-mounted workpiece stacker for a sewing machine, the stacker being simple and compact in construction and providing a stacked bundle of workpiece adjacent the front of a machine so that the operator may tie up and unload the bundle while remaining in her seated position.

Another object of the invention resides in the provision of a workpiece stacker for a sewing machine mounted on a table, the stacker being positioned at the side of the table and comprising a workpiece stacking arm adjacent the front of the table and readily accessible to the operator from her seated position, a workpiece removal arm mounted on the rear of the table behind the sewing machine for moving a workpiece to the side of the table, and a transfer arm for receiving the workpiece from the removal arm and transferring it forward and depositing it on the stacking arm.

Still another object of the invention resides in the provision of a workpiece stacker as described above, whereby the stacker conserves valuable space behind the sewing machine table and allows the operator to remove a stacked bundle from the stacker arm while remaining in her seated position.

A further object of the invention resides in the provision of a workpiece stacker as described above, whereby control means are provided to fully automate operation of the stacker.

Other objects and advantages will become apparent from reading the following detailed description of the invention with reference being made to the accompanying drawings wherein like numerals indicate like elements.

DETAILED DESCRIPTION OF THE INVENTION

Figure 1:
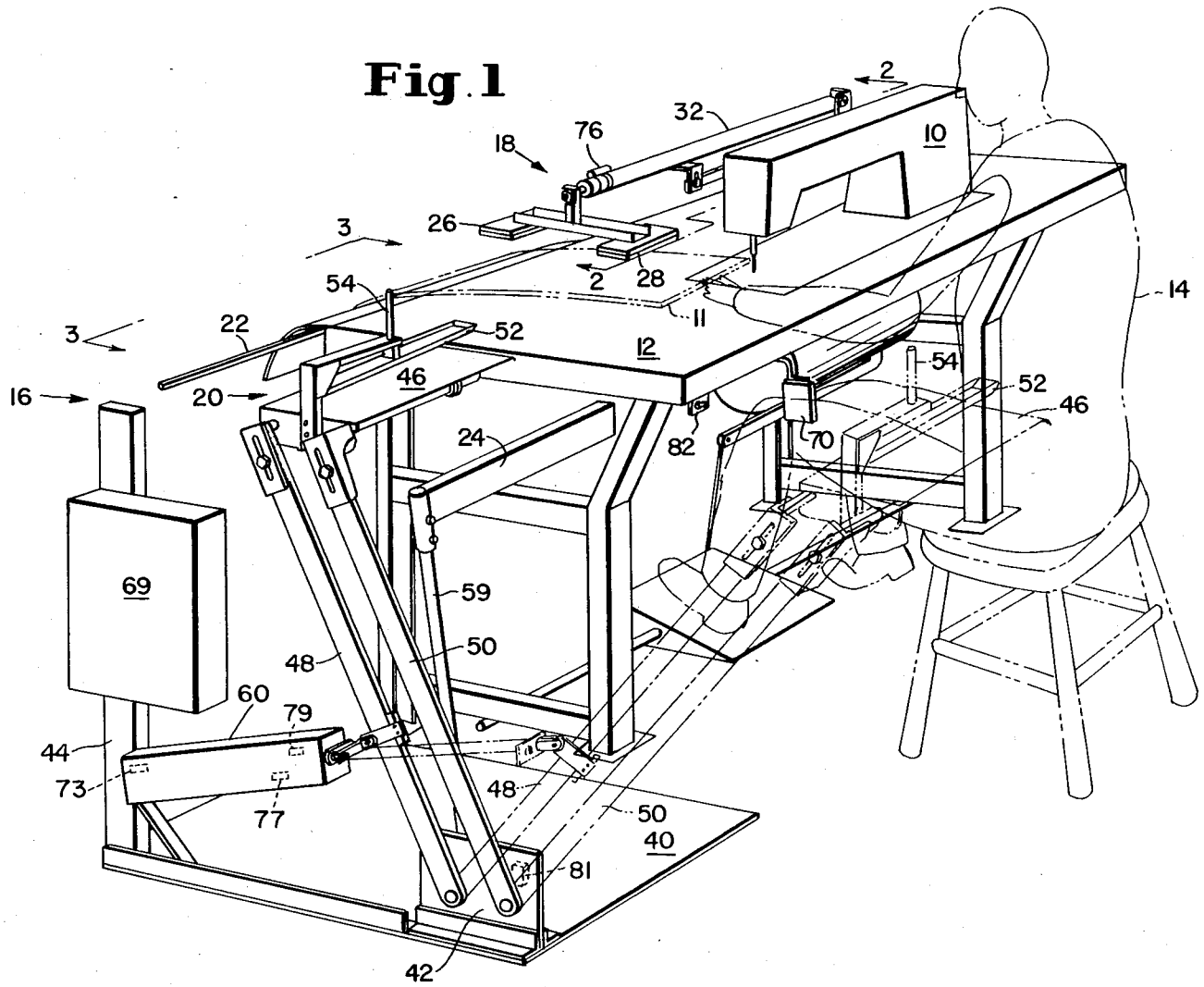
FIG. 1 is a fragmentary perspective view of the novel workpiece stacker of the invention.

Referring now to FIG. 1, an electric sewing machine 10 is mounted on table 12 and operated in conventional fashion by an operator 14 seated in front of the machine. The operator pushes the cloth through the needle of the mechine and the stitched workpiece 11, eg. a pair of pants, comes to rest on the rear surface of table 12 directly behind machine 10.

The workpiece stacker mechanism 16 of the invention includes an extensible removal arm 18, a pivotable transfer arm 20, a retractable guide arm 22, and a horizontal stacking work support arm 24 which cooperate together to remove the finished pants from the rear surface of table 12 and deposit them in a stack on support arm 24.

Figure 2:
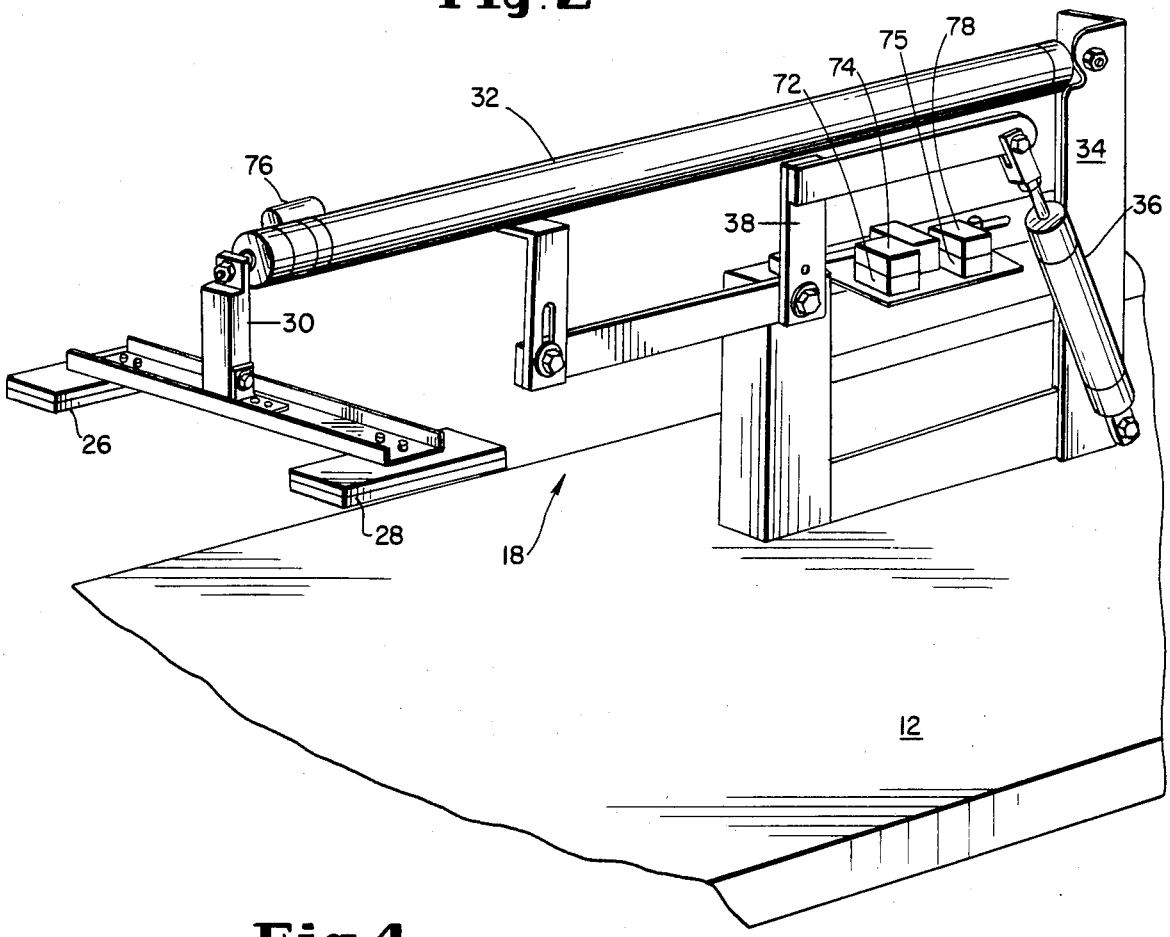
FIG. 2 is a fragmentary sectional view taken along line 2—2 of FIG. 1 illustrating the details of the workpiece removal arm mounted on the rear of the sewing machine table.

As shown in FIGS. 1 & 2 removal arm 18 is mounted on the rear surface of table 12 to move the finished workpiece transversely across the table to the side where it is engaged by arm 20. Arm 18 includes a pair of workpiece engaging friction pads 26 and 28 mounted on bracket 30 which is connected to the forward end of the piston rod of transversely extensible air cylinder 32. Cylinder 32 is pivotally connected at its rearward end for up and down movement to bracket 34 fixed to table 12. Air cylinder 36 is pivotally connected at its lower end to bracket 34 and at its upper end to one end of pivotable linkage assembly 38, the other end of the linkage being fixed to cylinder 32.

Stacking mechanism 16 also includes a base plate 40 resting on the floor at the side of table 12, a bracket 42 fixed on the front corner of plate 40 and a vertical post 44 fixed at the rear corner.

Figure 3:
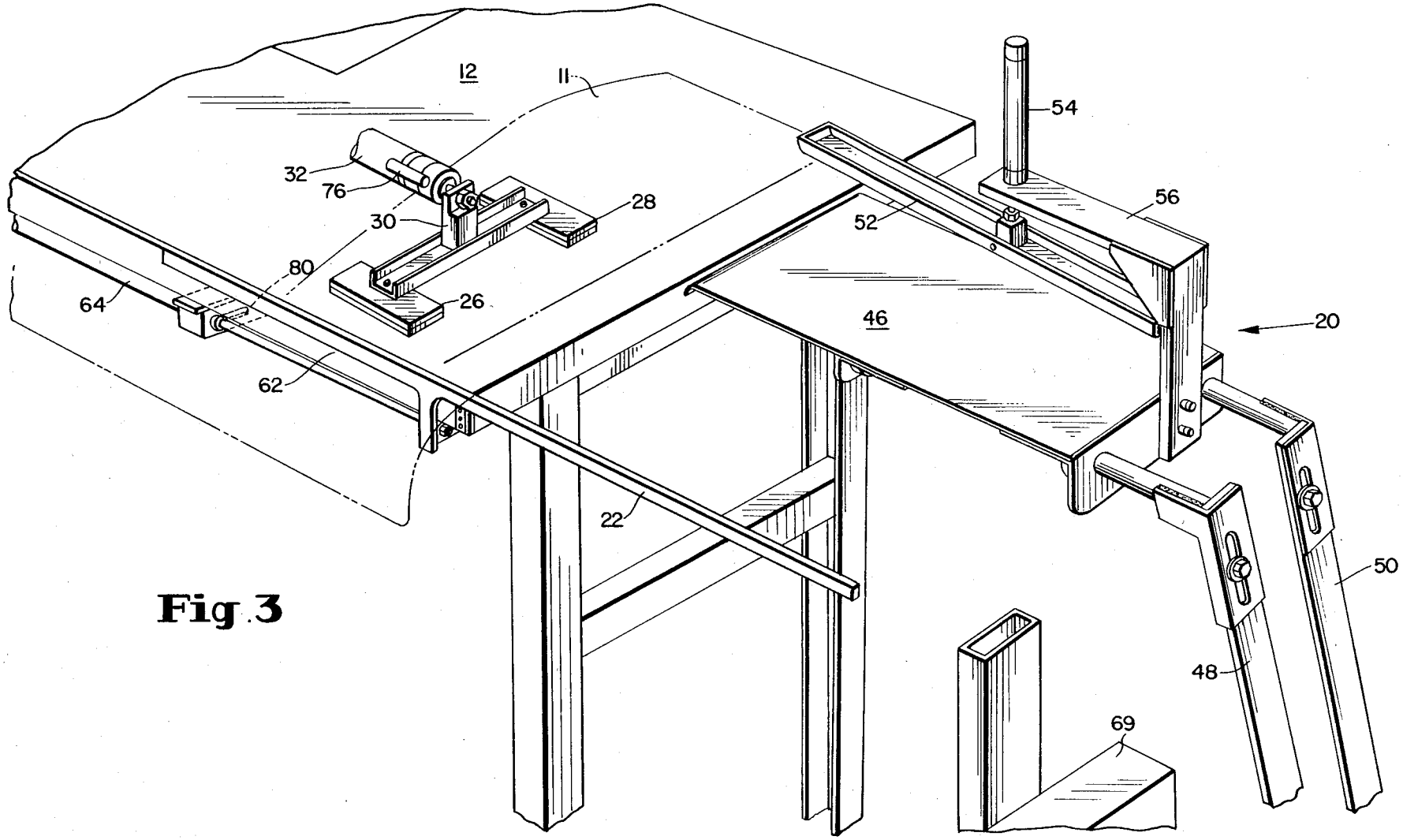
FIG. 3 is a fragmentary sectional view taken along line 3—3 of FIG. 1 illustrating a retractable workpiece guide arm mounted on the back of the sewing machine table and the clamp mechanism mounted adjacent the side of the table.

As shown in FIG. 1 and 3, transfer arm 20 includes a horizontal bedplate 46 adjustably connected to the upper ends of a pair of pivot rods 48 and 50 which are pivotally connected at their lower ends to bracket 42. Bed plate 46 is adjusted to the same height as table 12 so that workpiece 11 is transferred smoothly from the rear of the table to the bedplate. An upper clamp element 52 is pivotally connected to the rod end of a vertical air cylinder 54 mounted on bracket 56 fixed to bedplate 46. During operation workpiece 11 becomes engaged between bedplate 46 and clamp 52.

Horizontal work stacking arm 24 is mounted on rod 59 which is pivotally connected at its lower end to bracket 42. As shown in FIG. 1, arm 24 is normally positioned to the front of and slightly below bedplate 46 so as to readily receive the workpiece to be stacked. Once arm 20 receives workpiece 11 from arm 18, arm 20 is pivoted to its forward broken line position shown in FIG. 1 by air cylinder 60 connected between post 44 and pivot rod 48. In this position the workpiece is draped over and ultimately deposited on stacking arm 24.

To assist in the smooth transfer of workpiece 11 from table 12 to bedplate 46, stacker 16 includes the retractable guide arm 22 which is mounted for sliding movement within a track assembly 62 fixed on the back edge of table 12 (see FIG. 3). Air cylinder 64 moves arm 22 back and forth.

Figure 6:
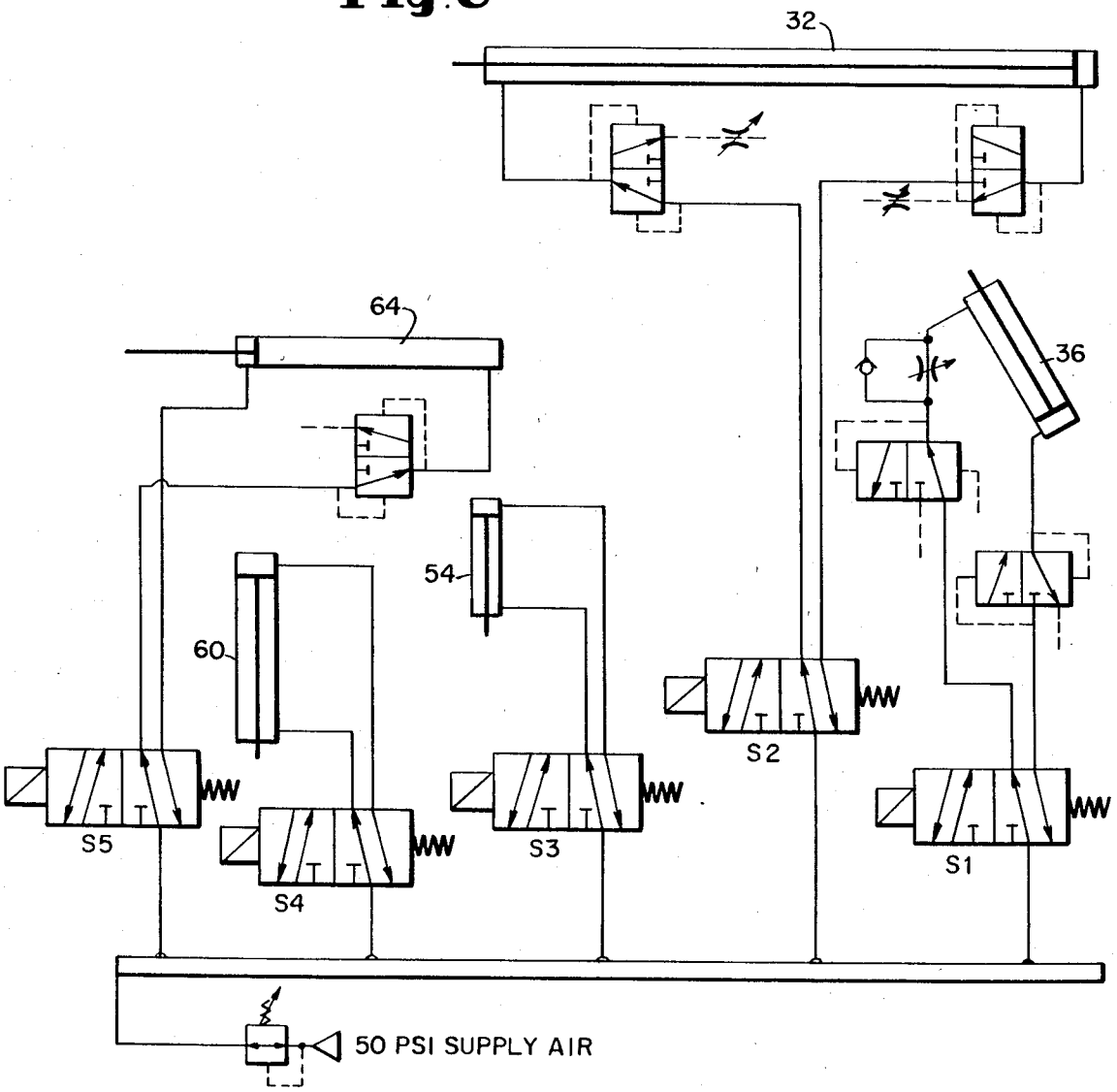
FIG. 6 is a schematic of the pneumatic circuit for operating the stacker.
Figure 5:
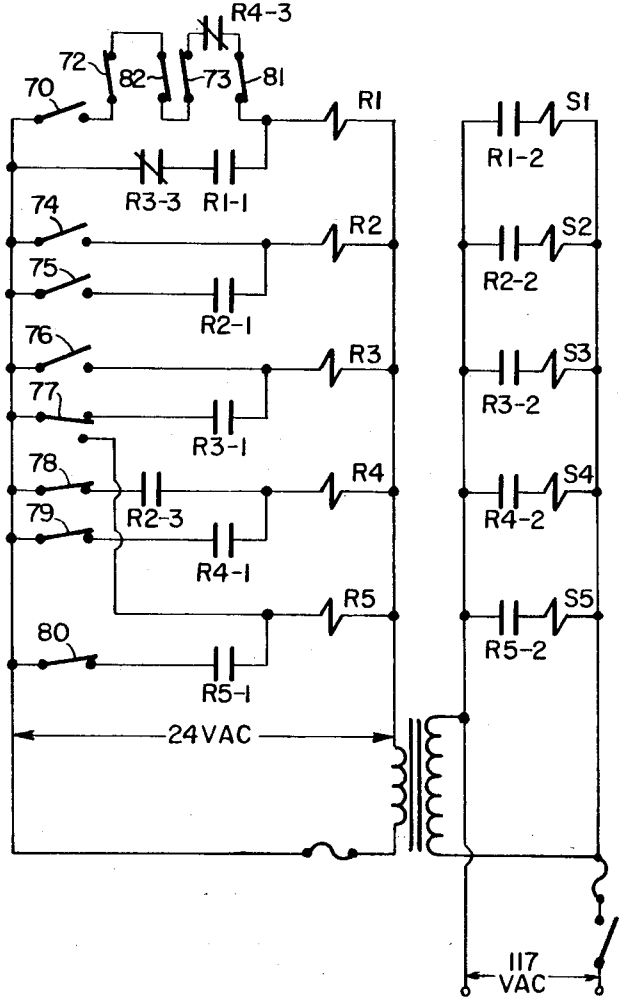
FIG. 5 is an electrical schematic of the control circuit by which the stacker of the invention is automatically operated.

Operation of the stacking mechanism will now be described with reference being made to the electrical and pneumatic schematics shown in FIGS. 5 and 6. The electrical components are housed in control box 69 mounted on post 44. All the components are initially positioned at rest as shown in full line in FIG. 1 and as shown in FIGS. 5 and 6. When operator 14 completes a workpiece 11, with her knee she momentarily closes switch 70 to energize relay R1, closing holding contacts R1-1 and also contacts R1-2 to energize solenoid operated valve S1 and actuate air cylinder 36. Air cylinder 32 is pivoted downward so that pads 26 and 28 engage with workpiece 11. As cylinder 36 is extended, switches 72 and 78 are opened and switches 74 and 75 are closed. Safety switch 72 opens to open the starting circuit for relay R1 so that it can not be restarted during the same cycle. Switch 74 is closed to energize relay R2, closing contacts R2-1, R2-2, and R2-3. Contacts R2-1 provide a holding circuit for relay R2. Closing contacts R2-2 energizes solenoid operated valve S2 to actuate air cylinder 32. This extends the cylinder and moves workpiece 11 transversely across the rear of the table toward transfer arm 20 waiting at the side of the table.

When cylinder 32 is fully extended, pads 26 and 28 place workpiece 11 on top of retractable arm 22 and bed plate 46, with the portion of the workpiece in front of pad 28 positioned between clamp 52 and bedplate 46. A magnetic reed switch 76 located on the front of cylinder 32 is closed, energizing relay R3 to close contacts R3-1, R3-2 and open contacts R3-3. Closure of contacts R3-2 energizes solenoid operated valve S3 to actuate air cylinder 54 and move clamp 52 down into gripping engagement with workpiece 11.

Opening of contacts R3-3 causes relay R1 to be deenergized, thereby opening contacts R1-2 and deactuating air cylinder 36. Pads 26 and 28 are then raised off workpiece 11. When cylinder 36 returns to its normal retracted position, switch 74 is opened and switch 78 recloses slightly before switch 75 opens to allow relay R2 to stay on long enough to maintain a path through R2-3 so that relay R4 is energized before relay R2 is deenergized. As relay R2 is deenergized contacts R2-2 open to retract cylinder 32 to its normal position.

Energization of relay R4 closes contacts R4-1, R4-2 and opens contacts R4-3. Closing contacts R4-2 energizes solenoid operated valve S4 to actuate cylinder 60, causing it to extend forward to move bedplate 46 to its forward broken line position shown in FIG. 1. This pulls the workpiece which is clamped between bedplate 46 and clamp 52 across the top of retractable arm 22 ready for deposition on stacking arm 24. The open contacts R4-3 keep relay R1 from being energized between the reaction time of safety switch 72, which closes as cylinder 36 is retracted, and switch 73, which opens as cylinder 60 starts to extend. As air cylinder 60 extends forward within about 2" of its full stroke, switch 77 is momentarily actuated to deenergize relay R-3 and to energize relay R5.

Deenergizing relay R3 closes contacts R3-3 and opens contacts R3-1 and R3-2, the latter causing air cylinder 54 to be retracted and raise clamp 52 off the workpiece slightly before cylinder 60 reaches its fully extended position.

Energizing relay R5 closes contacts R5-1 and R5-2 to energize solenoid operated valve S5 to actuate retractor air cylinder 64, causing retractor arm 22 to move inwardly within track assembly 62 and slip out from under the workpiece on top of it at the same time clamp 52 is released. The workpiece is then free to drop to stacking arm 24 and drape over it.

When arm 22 is fully retracted, switch 80 is momentarily opened to deenergize relay R5, opening contacts R5-1 and R5-2 and causing cylinder 64 to return arm 22 to its normally extended position.

When cylinder 60 reaches its fully extended position, switch 79 is opened to deenergize, relay R4, closing contacts R4-3 and opening contacts R4-1 and R4-2, thereby causing cylinder 60 to retract and return bedplate 46 to its normal position. Safety switch 73 will close to complete the cycle, and the stacker is ready for the next workpiece.

Figure 4:
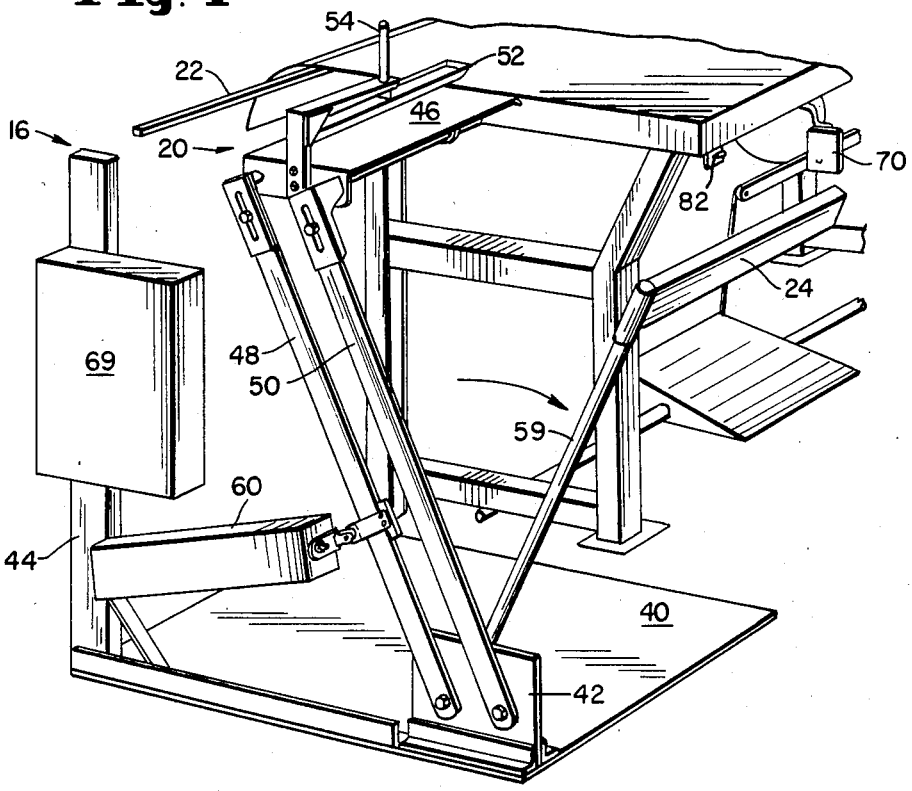
FIG. 4 is a fragmentary schematic view similar to FIG. 1 but illustrating the workpiece stacker arm in its forward position from which the operator may remove the bundle of stacked goods while remaining in her seated position.

When the desired number of workpieces are stacked on arm 24, operator 14, while remaining in her seated position, need only to pull arm 24 forward to the position shown in FIG. 4, unload and tie the stack together, return arm 24 to its normal position, and resume her sewing operation. As a safety, when arm 24 is pulled to its unload position of FIG. 4, switch 81 is opened to prevent the stacker from being accidentally started.

The operator may also manually open switch 82 to prevent accidental starting of the cycle, e.g. while she is threading or changing needles.

From the above description it is apparent that the novel stacking mechanism of the invention conserves space around the machine, is simple and compact in construction and reliable in operation, and convenient and readily accessible to the operator.

It is to be understood that the above described embodiment of the invention is for illustrative purposes only and is not to be construed as limiting the invention. All modifications which do not depart from the spirit of the invention are intended to be included within the scope of the appended claims.

I claim:

1. In combination with horizontal table means and a sewing machine mounted on said table means, workpiece stacking means comprising workpiece moving means adapted to slide a finished workpiece from behind said sewing machine across the rear of said table means toward one side thereof; workpiece transfer means mounted adjacent said side of said table means and having horizontal surface means positioned at substantially the same height as said table means for smoothly receiving said workpiece from said table means; workpiece support means mounted adjacent said side toward the front of said table means where an operator normally sits, said support means including a horizontal stacking arm positioned in front of and slightly below said horizontal surface means, said transfer means including a clamp means for clamping said workpiece on said horizontal surface means; means for actuating said transfer means from a rearward position where said horizontal surface means smoothly receives said workpiece as it is slid off said table means to a forward position where it drapes said workpiece over said stacking arm, whereby a number of workpieces may be stacked on said stacking arm at a location convenient and readily accessible to an operator.

2. The combination of Claim 1, said workpiece moving means comprising an extensible arm mounted on said table and being movable to grip a workpiece and slide it across said table means toward said transfer means.

3. The combination of claim 1, said transfer means including horizontal plate means defining said horizontal surface means and said clamp means clamping said workpiece on said plate means as said transfer means is moved to its forward position.

4. The combination of claim 3, said stacking means including control means for automatically operating said moving means and said transfer means in proper sequence to stack workpieces on said support means.

5. The combination of claim 1, said stacking means further comprising retractable guide means for supporting and griding said workpiece as it is moved from said table means onto said horizontal surface and transferred to said stacking arm, said guide means being retracted from said workpiece as said workpiece is draped over said stacking arm.

6. The combination of claim 5, said stacking means including control means for automatically operating said moving means, said transfer means, and said retractable guide means in proper sequence to stack workpieces on said support means.

7. The combination of claim 1, said horizontal stacking arm being pivotable toward the front of said machine so that the stacked workpieces are easily removed by the operator.

* * * * *